US005173031A

United States Patent [19]

Nonnenmacher et al.

[11] Patent Number: 5,173,031

[45] Date of Patent: Dec. 22, 1992

[54] DELIVERY FLOW AND PRESSURE CONTROLLING DEVICE FOR A HYDROSTATIC PUMP

[75] Inventors: Gerhard Nonnenmacher, Korntal-Münchingen; Egon Tittmann, Leonberg; Heinz Walter, Rutesheim; Walter Robeller, Böblingen; Dieter Bertsch, Neuhausen, all of Fed. Rep. of Germany

[73] Assignee: Robert Bosch GmbH, Stuttgart, Fed. Rep. of Germany

[21] Appl. No.: 601,741

[22] PCT Filed: Feb. 16, 1990

[86] PCT No.: PCT/DE90/00100

§ 371 Date: Oct. 26, 1990

§ 102(e) Date: Oct. 26, 1990

[87] PCT Pub. No.: WO90/10793

PCT Pub. Date: Sep. 20, 1990

[30] Foreign Application Priority Data

Mar. 8, 1989 [DE] Fed. Rep. of Germany ..... 3907409

[51] Int. Cl.[5] ..... F04B 49/08

[52] U.S. Cl. ..... 417/218

[58] Field of Search ..... 417/218, 219, 220, 221, 417/222 R

[56] References Cited

FOREIGN PATENT DOCUMENTS 2913534 10/1980 Fed. Rep. of Germany ..... 417/218

*Primary Examiner*—Leonard E. Smith

*Attorney, Agent, or Firm*—Michael J. Striker

[57] ABSTRACT

The flow controlling device for a hydrostatic pump has a servo-piston (12) for adjusting the actuating element (11) of the adjustable pump (10) which is acted upon by a control pressure. The latter is controlled by a regulating valve (22) which is acted upon by a pressure differential across a measuring throttle (16) arranged in the delivery line (15) of the pump. Moreover, a pressure spring (23) acts on the regulating valve against the higher pressure. An external pressure supply (26) (pressurized reservoir) is provided for preparing the control pressure. To obtain an accurate, rapid flow control, even for low operating pressures, a connection line (76, 71) connecting the high-pressure side of delivery line (15) to the control pressure connector of the servo-piston (12) is provided, which contains a fixed throttle (72). Alternatively, the regulating valve may be replaced by two spatially separate valves, a flow regulator (80) and a pressure regulator (81).

4 Claims, 3 Drawing Sheets

DELIVERY FLOW AND PRESSURE CONTROLLING DEVICE FOR A HYDROSTATIC PUMP

BACKGROUND OF THE INVENTION

The invention is related to a device on an adjustable hydrostatic pump for regulating the delivery flow and, as necessary, also the delivery pressure of same. The demands on the control rate of such adjustable pumps have grown considerably. One of the limits for this control rate is determined by the pressure level of the control flow. This is generally ascertained from the inherent delivery flow of the pump; this is also why its pressure can reach, at most, the level of the initial pressure of the pump. At low operating pressure of the pump, this inevitably leads to limitations of the control rate. As remedies, solutions—e.g. according to FIG. 1 of the drawing—are known which connect the control system with an auxiliary pressure source in phases of low operating pressure. This can be an external pressure supply or a pressure storage system which is recharged from the pump's own circulation during the high-pressure phase in the work cycle. However, a disadvantage in these known devices consists in that a high pressure level now also occurs at low operating pressure at the control edge of the pump regulator. The high regulating accuracy of a conventional regulator—particularly in the flow control at low operating pressure—is accordingly considerably reduced. This results from the fact that the pressure from which the control pressure is obtained no longer has a fixed relationship to the pressure required in the adjusting piston space. The regulating valve must therefore adjust the pressure divider ratio in the decisive position by means of small changes in position by means of its throttle cross section during every fluctuation in load pressure. In so doing, the effective control pressure differential changes, and the accuracy of the delivery flow deviates from the high standard which is in effect when the operating pressure is approximately equal to the control pressure.

SUMMARY OF THE INVENTION

It is therefore an object of the present invention to provide a more accurate rapid control of the flow and, as needed, the delivery pressure of a hydrostatic pump, especially for low operating pressures.

This object and others will be made more apparent hereinafter is attained in a flow controlling device on an adjustable hydrostatic pump having an actuating element. The hydrostatic pump delivers a flow over a delivery line at a delivery flow rate and delivery pressure and the flow controlling device regulates the delivery flow and also, as needed, the delivery pressure. The actuating element is adjustable against a counterforce by at least one servo-piston which is acted upon by a control pressure. The control pressure is controlled in a regulating valve. Specifically, when an actual value of a delivery flow or delivery pressure is in approximate agreement with a reference value of the delivery flow or delivery pressure, respectively, the control pressure is controlled by means of a pressure divider which comprises the combination of a fixed throttle and a variable throttle in the regulating valve acted upon by the pressure differential across a measuring throttle arranged in the delivery line or the pressure differential across a throttle arranged in a line to a pilot valve, as well as a control spring which acts against the higher of the two pressures on the regulating valve. The flow controlling device also includes an auxiliary pressure source which can act on the servo-piston directly or indirectly via the regulating valve.

According to the invention the device for controlling flow and pressure of a hydrostatic pump further comprises means for obtaining the control pressure from a pressure of the delivered flow from the pump (switching position II of the regulating valve) via the pressure divider, when the actual value and reference value approximately agree, and, when they do not agree, means for obtaining the control pressure from a source of higher pressure for adjusting the pump (switching position III or IV), and wherein the servo-piston is relievable of pressure for resetting the pump (switching position I).

In contrast, the appliance, according to the invention, has the advantage that the servo-piston is supplied by different control pressure sources in the different positions of the regulating valve. In this way, a high control rate as well as an extremely accurate adjustment of the pump and of the pressure medium flow delivered by it are obtained.

A connection line may be provided connecting the high-pressure side of the delivery line to the servo-piston and a fixed throttle can be located in the connection line to help provide the more accurate rapid control at low operating pressures. Also, the servo-piston may be indirectly connected via the regulating valve to the delivery line. Alternatively, the regulating valve comprises two spatially separate valves, namely a flow regulator and a pressure regulator. The auxiliary pressure source may be a pressurized reservoir, which is charged at a delivery pressure, which is comparatively high relative to other delivery pressures, via a check valve and a throttle from the delivery line.

BRIEF DESCRIPTION OF THE DRAWING

The objects, features and advantages of the present invention will now be illustrated in more detail by the following detailed description, reference being made to the accompanying drawing in which.

DESCRIPTION OF THE EMBODIMENT EXAMPLES

Figure 1:
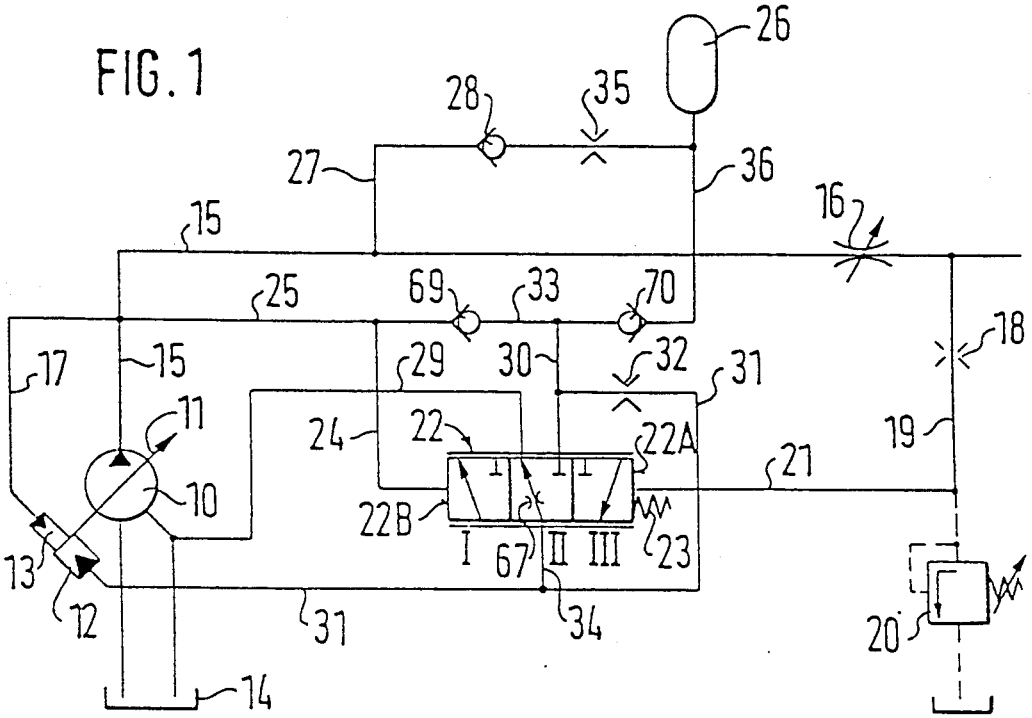
FIG. 1 is a schematic diagram of a device for pressure and flow control for an adjustable pump according to the prior art.

In the embodiment example according to FIG. 1, which—as mentioned above—shows a device for regulating the delivery flow and—optionally—also the delivery pressure of an adjustable pump according to the prior art, an adjustable pump is designated by 10, its actuating element 11 being adjusted by means of two servo-pistons 12, 13 which are acted upon by pressure and have unequal surface areas. The pump 10 sucks pressure medium out of a container 14 and displaces it into a delivery line 15 in which an adjustable measuring throttle 16 is arranged. A line 17 leading to the servo-piston 13 having the smaller area is connected to the delivery line 15. Another line 19 which leads to an adjustable pilot valve 20 and in which a throttle 18 is arranged is connected to the delivery line 15 downstream the measuring throttle 16. A line 21 leads from the line 19 to the right front side 22A of a 3/3 regulating valve 22 with the switching positions I to III with smooth transition. A control spring 23 also acts on the front side 22A. A line 24 leads to the left front side 22B of the regulating valve 22, which line 24 proceeds from a line 25 which is connected to the delivery line 15 and leads to a line 33 via a first check valve 69, to a line 36 via a second check valve 70, and to a pressurized reservoir 26. A line 27 proceeds from the delivery line 15 and leads into the line 36 via a check valve 28 and a throttle 35.

Two lines 29, 30 lead into the longitudinal side of the regulating valve 22, the line 29 leads to the container 14 and the line 30 leads into the line 33, specifically between the check valves 69, 70. A line 31, which leads to the adjusting piston 12 with the larger piston area, branches off from the line 30 via a throttle 32. In addition, another line 34, which leads to the other side of the regulating valve 22, branches off from the line 31. As mentioned earlier, this regulating valve 22 can occupy three switching positions I, II and III with smooth transitions, wherein a throttle symbol 67 corresponding to the throttle position at a control edge of the regulating valve during the transition between switching positions I and III is illustrated in the middle position II.

When the pump 10 delivers pressure medium into the delivery line 15, a pressure difference acting on the regulating valve 22 via the lines 15, 25 and 19, 21 occurs at the measuring throttle 16. The delivery pressure of the pump prevails constantly at the servo-piston 13 having the smaller area, a control pressure which is produced by the adjustment of the regulating valve 22 prevails at the servo-piston 12 having the larger area.

When the delivery flow of the pump 10 coincides with the value adjusted at the measuring throttle 16, the pressure difference at this measuring throttle produces a force at the end faces 22A and 22B of the regulating valve 22, which force corresponds to the force of the control spring 23 in position II of the regulating valve. A smaller flow, which is at least under pump delivery pressure via the check valve 69, flows out of the line 33, 30 via the throttle 32 into the line 31. An identical pressure medium flow flows out of the line 31 to the tank 14 via line 34, control edge 67 and line 29. There is no flow to the servo-piston 12 or returning from the latter; the pump therefore maintains its immediate position.

If the delivery pressure is too great, the pressure differential at the measuring throttle 16 is higher than that allowed by the control spring 23 and the regulating valve 22 is therefore displaced into position I, whereupon more pressure medium flows to the tank 14 from line 31 via line 34, the regulating valve and line 29 than can flow via the throttle 32. The pressure in the servo-piston 12 accordingly drops and the delivery pressure prevailing in the servo-piston 13 adjusts the pump to a smaller delivery volume.

If the delivery flow of the pump is too small, the pressure differential at the measuring throttle 16 is smaller than allowed by the control spring 23 and the regulating valve is moved into position III. The flow from line 31 via control edge 67 to the tank is then interrupted and another connection, through which the pressure medium flows to the line 31, is opened to the line 30 instead. The pressure now increases in the servo-piston 12 and adjusts the pump to greater delivery volume.

When the pilot valve 20 responds, the regulating valve 22 becomes a pressure regulator. When the pilot valve (20) opens, the pressure in line 21 drops suddenly and the regulating valve 22 is switched into switching position I. The servo-piston 12 is now connected to the container, while the servo-piston 13 resets the pump and lowers the delivery pressure. Without devices 20 and 18, the regulating valve 22 is a pure delivery flow regulator. These mechanism are sufficiently known.

Increasingly greater demands are made on the control rate of such devices. One of the limits for this control rate is determined by the pressure level of the control flow. The latter is generally ascertained from the inherent delivery flow of the pump; this is also why its pressure can reach, at most, the level of the initial pressure of the pump. At low operating pressure of the pump, this inevitably leads to limitations of the control rate. As a remedy, an auxiliary force source—the pressurized reservoir 26 in the embodiment example—is provided. This can be recharged from the pump circulation during the high-pressure phase in the work cycle via the check valve 28 and the throttle 35. The line 33 which supplies the regulating valve 22 with control flow is connected with the higher of the two pressures—pump pressure or auxiliary pressure—selected by means of the two check valves 69 and 70.

However, a disadvantage in the known solution consists in that there is now a high pressure level at the throttle 32, which is usually realized as a notch or cut in a control collar of the regulating valve, also at low operating pressure. A high control rate is accordingly achieved, but the high regulating accuracy of a conventional regulator is considerably reduced, particularly with respect to the flow regulating function at low pressure. This is because there is a load-independent external pressure at the high-pressure side of the pressure divider formed in switching position II by the throttle 32 and control edge throttle 67, although the pressure required at the tap for the piston 12 is highly dependent on the pump pressure—already via the force of the servo-piston 13. The regulating valve must therefore correct the pressure divider ratio during every fluctuation of the system pressure in switching position II which is decisive for accuracy. This is effected by means of a small change in the flow cross section at the control edge 67, i.e. by means of an adjustment of the equilibrium position. The effective regulating pressure difference and the accuracy of the delivery flow accordingly deviate from the high standard which applies when the control and operating pressures are identical.

Figure 2:
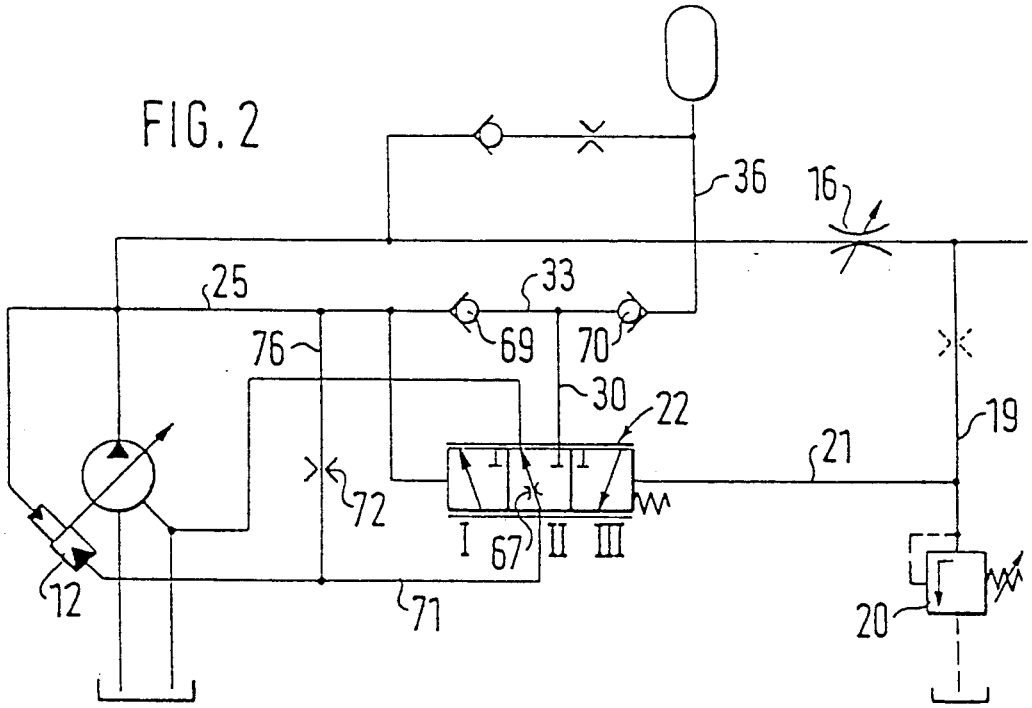
FIG. 2 is a schematic view of a first embodiment example of the invention differing from prior art device shown in FIG. 1.

In order to overcome this disadvantage, in the embodiment example, according to the invention, according to FIG. 2—which corresponds to the greatest extent with that of FIG. 1—a line 76 with built-in throttle 72 is guided from the line 25 to a line 71 which proceeds from the regulating valve 22 and leads to the servo-piston 12. This is a part of the line 31, according to the embodiment example according to FIG. 1, which is now omitted in its area from line 30 to line 34. The high-pressure line 25 is now connected directly with the control line 71 to the servo-piston 12 via the throttle 72.

In contrast to the regulator arrangement, according to FIG. 1, described in the beginning, the servo-piston 12 is supplied by different control pressure sources in the different switching positions of the regulating valve 22, i.e. directly by the pump delivery pressure via the line 76 in one instance, and via the line 30 from the pressurized reservoir 26 in another instance, assuming that its pressure is higher than the pump pressure.

The following functions correspond to the three switching positions of the regulating valve 22 which pass into one another smoothly:

Position I

The differential pressure force produced by means of the pressure difference at the measuring throttle 16 or at the throttle 18 is greater than the average force of the control spring 23, i.e. $Q_{actual}$ is greater than $Q_{reference}$ in the flow regulator, $p_{actual}$ is greater than $p_{reference}$ in the pressure regulator. The servo-piston 12 is now connected with the container via the regulating valve. The pump is adjusted in the direction of smaller stroke volume by means of the pressure acting at the servo-piston 13.

In switching position II of the regulating valve 22, the differential pressure force equals the average force of the control spring 23, i.e. $Q_{actual}$ equals $Q_{reference}$ in the flow regulator, $p_{actual}$ equals $p_{reference}$ in the regulating of pressure. A small pressure medium flow flows from the high-pressure side of the pump to the servo-piston 12 via the throttle 72. In the state of equilibrium of the regulating valve (pump position equals reference value), an equally great pressure medium flow flows from the servo-piston connection to the tank via the throttle control edge 67. The immediate delivery position of the pump is therefore maintained. Even small deviations from the reference value temporarily change the equilibrium position and the flow cross section. Such deviations accordingly lead to sensitive adjustment of the delivery volume in the usual manner. Since the system pressure of the pump, and not the pressure of the pressurized reservoir 26, occurs at the pressure divider (throttle 72, control edge 67) in the accustomed manner, the function of the regulator in switching position II does not differ from a conventional regulator with its high accuracy and sensitivity. This is also true for the flow regulating function at low pressure. The throttle 72 in line 76, which is shown here as external throttle, can also be constructed inside the regulating valve 22, e.g. as a cut at a control collar.

In switching position III of the regulating valve 22, the differential pressure force is smaller than the average force of the measurement spring 23, i.e. $Q_{actual}$ is smaller than $Q_{reference}$ during flow regulation, $p_{actual}$ is smaller than $p_{reference}$ during pressure regulation. A pressure medium flow flows from the line 33, 30 to the line 71 and the servo-piston 12 via the regulating valve 22. Since the higher level of the pump or auxiliary pressure (selected by means of the two check valves 69 and 70) prevails in the line 33, the pump position—even at low operating pressure—adjusts in the direction of higher stroke volume with great force reserve and therefore quickly. Shortly before reaching the new equilibrium position, the connection to the line 30 is interrupted, and the regulating valve 22 adjusts the pump into the exact new delivery position in switching position II and therefore with inherent pressure supply.

The pump regulator, according to the invention, accordingly combines the high regulating accuracy of a conventional regulator with the high control rate of a pump controller supplied by external pressure.

Figure 3:
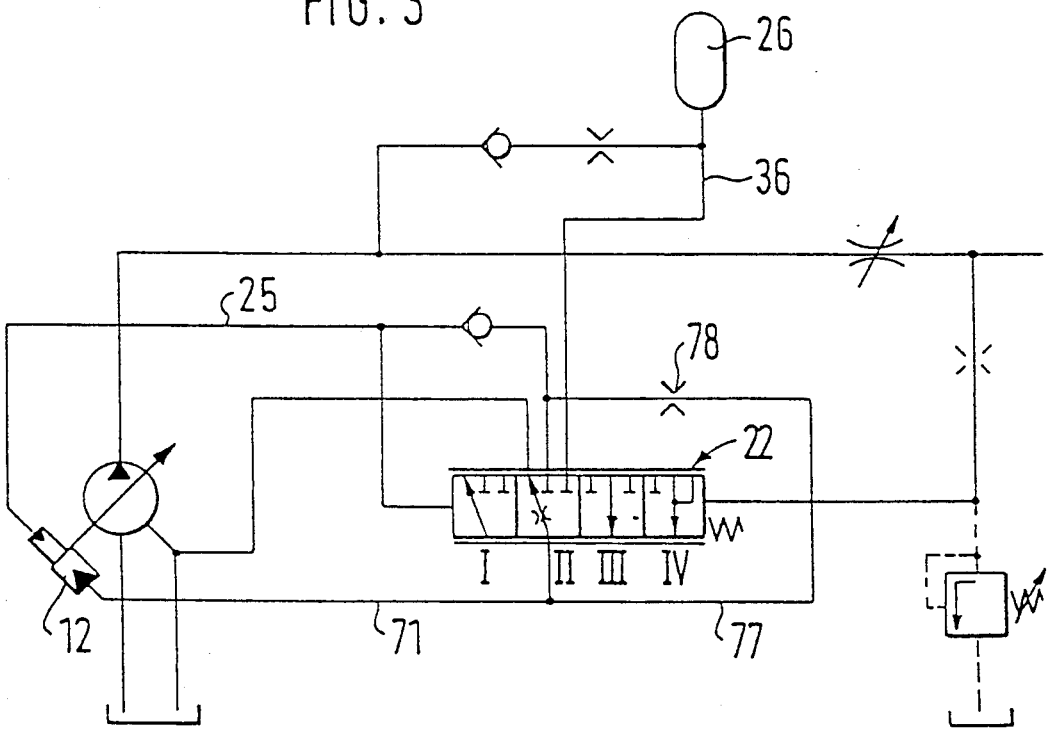
FIG. 3 is a schematic diagram of another embodiment example of a pressure and flow control device for an adjustable pump.

A variant of the embodiment example according to FIG. 2 is shown in FIG. 3. In contrast, the storage line 36 is guided in this instance to a special connection of the regulating valve 22. For purpose of better clarity only, four different switching positions are shown for the regulating valve 22 (any number of intermediate positions can be shown during the smooth transition between the positions). The manner of operation corresponds to the embodiment example according to FIG. 3. The regulating valve acts like a conventional regulator (e.g. that according to FIG. 1 without external pressure line 36) in switching positions I–III. The accustomed speed of a flow or pressure flow regulator is accordingly completely maintained. During large negative regulating deviations (differential pressure force clearly below the average force of the control spring), the external pressure of the pressurized reservoir 26 is connected with the servo-piston 12 in switching position IV via an additional control edge of the regulating valve 22, so that the deviation from the reference value is corrected very quickly. Nevertheless, the regulating retains its high accuracy because the regulating valve—shortly before reaching the equilibrium position—switches again to the control pressure supply from the pump pressure.

Figure 4:
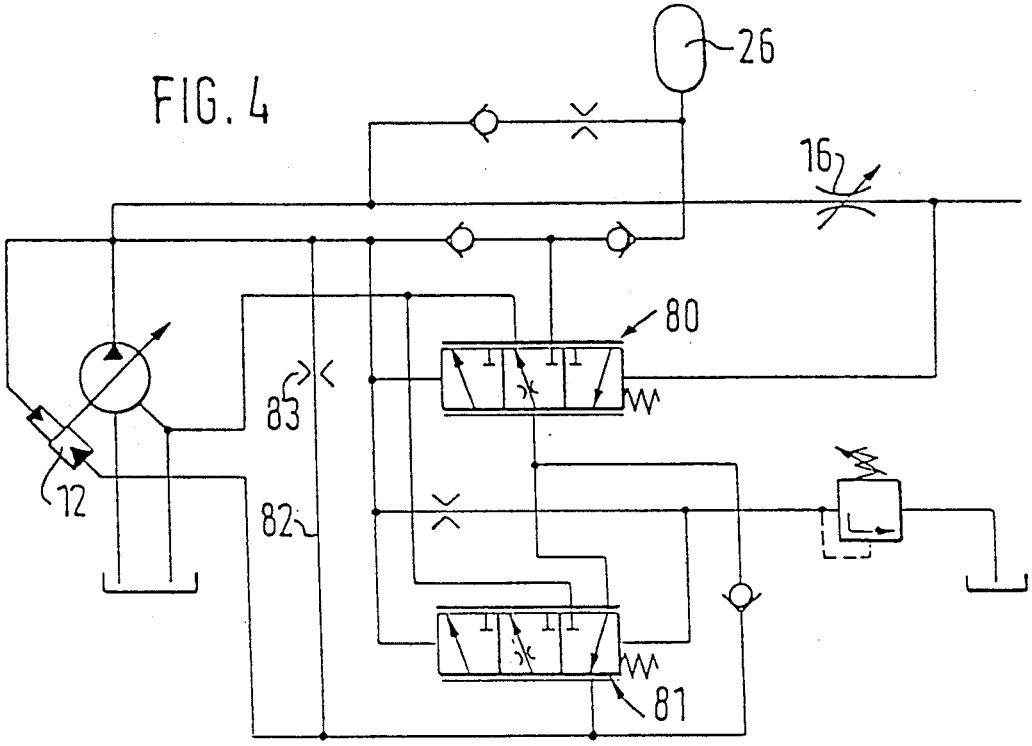
FIGS. 4 and 5 show other embodiments.
Figure 5:
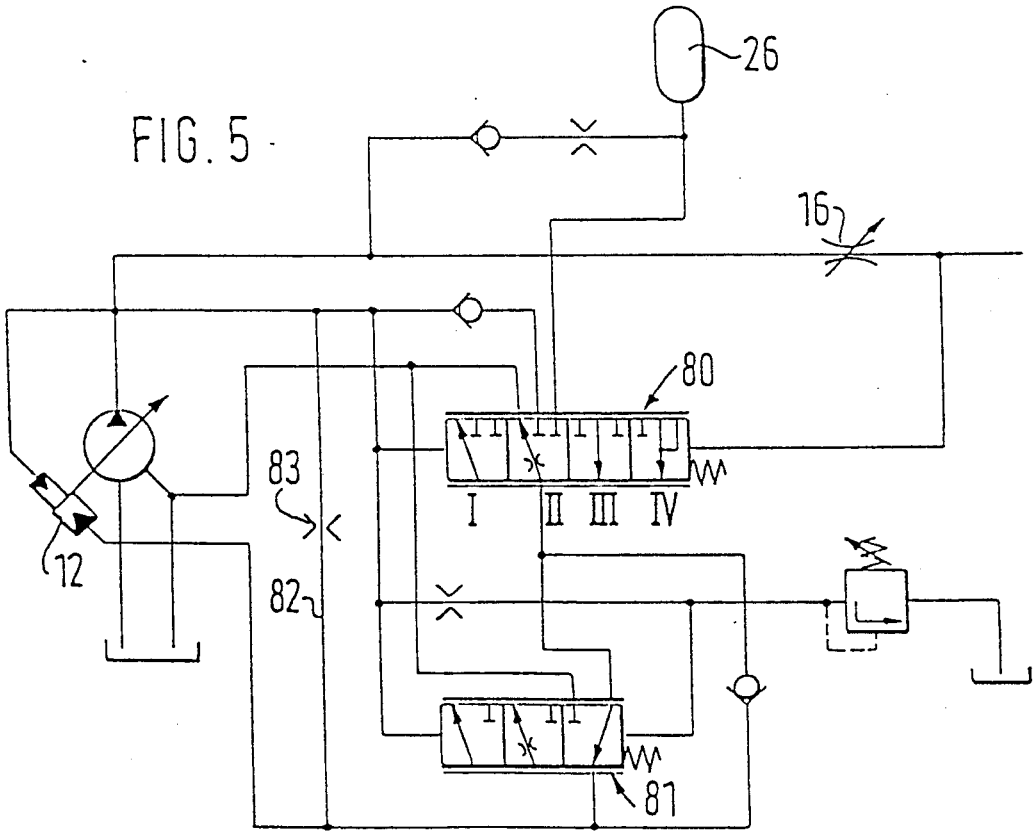

As shown by the embodiment examples according to FIGS. 4 and 5, the invention can also be realized in a construction comprising two separate regulating valves for flow and pressure regulation. In this instance, the flow regulator is designated by 80, the pressure regulator is designated by 81. The connection from the pressure storage 26 leads through the two valves and is then connected to the servo-piston 12. The pressure differential at the measuring throttle 16 prevails at the flow regulator 80, the absolute delivery pressure of the pump prevails at the pressure regulator 81. The direct connection line from the high-pressure side of the pump to the pressure connection for the servo-piston 12 is designated by 82, the throttle arranged in the latter is designated by 83.

A pressure spring can be used as a counterforce to the servo-piston 12 instead of the servo-piston 13.

It will be understood that each of the elements described above, or two or more together, may also find a useful application in other types of structures differing from the types described above.

While the invention has been illustrated and described as embodied in a flow controlling device for a hydrostatic pump, it is not intended to be limited to the details, shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. In a flow controlling device on an adjustable hydrostatic pump having an actuating element, said hydrostatic pump delivering a delivery flow over a delivery line at a delivery pressure and said flow controlling device regulating the delivery flow and also, as needed, the delivery pressure of same, said actuating element being adjustable against a counterforce by at least one servo-piston which is acted upon by a control pressure, wherein the control pressure is controlled by a regulating valve, and, when an actual value of one of a delivery flow and delivery pressure is in approximate agreement with a reference value of one of the delivery flow and delivery pressure provided by means for providing the reference value of same, the control pressure is formed by a pressure divider which comprises a combination of a fixed throttle and a variable throttle in the regulating valve acted upon by one of a pressure differential across a measuring throttle arranged in the delivery line and a pressure differential across a throttle arranged in a line to a pilot valve, and also by a control spring which acts against a higher one of the two pressures producing the pressure differential on the regulating valve, said flow controlling device also comprising an auxiliary pressure source which can act on the servo-piston indirectly via the regulating valve, the improvement comprising means for obtaining the control pressure from a pressure of the delivery flow from the pump (switching position II) via the pressure divider, when the actual value and reference value approximately agree, and, when there is not approximate agreement between the actual value and the reference value, means for obtaining the control pressure from a source of higher pressure for adjusting the pump (switching position III or IV), and means for relieving the servo-piston of pressure for resetting the pump (switching position I), and wherein a connection line (76,71) having a fixed throttle (72) therein connects the delivery line (15) to the servo-piston (12), only said fixed throttle (72) being present in said connection line (76,71).

2. The improvement as defined in claim 1, wherein the regulating valve comprises two spatially separate valves, a flow regulator (80) and a pressure regulator (81).

3. The improvement as defined in claim 1, wherein the auxiliary pressure source (26) is a pressurized reservoir, which is charged at a delivery pressure, which is comparatively high relative to other delivery pressures of the pump, via a check valve (28) and a throttle (35) from the delivery line.

4. In a flow controlling device on an adjustable hydrostatic pump having an actuating element, said hydrostatic pump delivering a delivery flow over a delivery line at a delivery pressure and said flow controlling device regulating the delivery flow and also, as needed, the delivery pressure of same, said actuating element being adjustable against a counterforce by at least one servo-piston which is acted upon by a control pressure, wherein the control pressure is controlled by a regulating valve, and, when an actual value of one of a delivery flow and delivery pressure is in approximate agreement with a reference value of one of the delivery flow and delivery pressure provided by means for providing the reference value of same, the control pressure is formed by a pressure divider which comprises a combination of a fixed throttle and a variable throttle in the regulating valve acted upon by one of a pressure differential across a measuring throttle arranged in the delivery line and a pressure differential across a throttle arranged in a line to a pilot valve, and also by a control spring which acts against a higher one of the two pressures producing the pressure differential on the regulating valve, said flow controlling device also comprising an auxiliary pressure source which can act on the servo-piston indirectly via the regulating valve, the improvement comprising means for obtaining the control pressure from a pressure of the delivery flow from the pump (switching position II) via the pressure divider, when the actual value and reference value approximately agree, and, when there is not approximate agreement between the actual value and the reference value, means for obtaining the control pressure from a source of higher pressure for adjusting the pump (switching position III or IV), and means for relieving the servo-piston of pressure for resetting the pump (switching position I), and wherein a connection line (76,71) having a fixed throttle (72) therein, and only said fixed throttle (72), connects the delivery line (15) to the servo-piston (12) and no direct connection is provided between the source of higher pressure and a control edge of the regulating valve so that the source of higher pressure does not act directly on the control edge of the regulating valve.

* * * * *